United States Patent [19]

Poll

[11] 4,356,633

[45] Nov. 2, 1982

[54] ELLIPSOGRAPH

[76] Inventor: Marian Poll, 1271 Northwest Hwy., Park Ridge, Ill. 60068

[21] Appl. No.: 286,774

[22] Filed: Jul. 27, 1981

[51] Int. Cl.[3] ..... B43L 11/04

[52] U.S. Cl. ..... 33/31

[58] Field of Search ..... 33/30, 31

[56] References Cited

U.S. PATENT DOCUMENTS

| | | | |
|---|---|---|---|
| 717,082 | 12/1902 | Dart | 33/31 |
| 4,148,144 | 4/1979 | Stiles | 33/31 |
| 4,174,572 | 11/1979 | Mikulin | 33/31 |

FOREIGN PATENT DOCUMENTS

| | | | |
|---|---|---|---|
| 779419 | 1/1935 | France | 33/31 |

*Primary Examiner*—Harry N. Haroian

[57] ABSTRACT

An ellipse drawing device is disclosed which utilizes mounted on its lower surface a rotary arm and an elongated plate in conjunction, generating a straight line motion of a point on the elongated plate, grouped in perpendicular relation to the grooves on its upper and parallel surface to guide a stylus carrying arm in the desired course.

1 Claim, 3 Drawing Figures

ELLIPSOGRAPH

This invention deals with an ellipsograph, more specifically, it relates to the type designed to be laid flat on the work and manipulated to describe an ellipse, once the dimensions of the two axes are known; and one object is to provide an instrument which can be adjusted with ease and to an infinite number of proportions. A further object is to provide an instrument of the above character, which utilizes a set of grooved plates and straight line generating arm grouped in perpendicular relation to guide the pencil carrying arm in the desired course.

The invention will be more readily understood and other objects and advantages will become apparent from the study of the following portion of this application, the claim and the attached drawings, in which:

Figure 1:
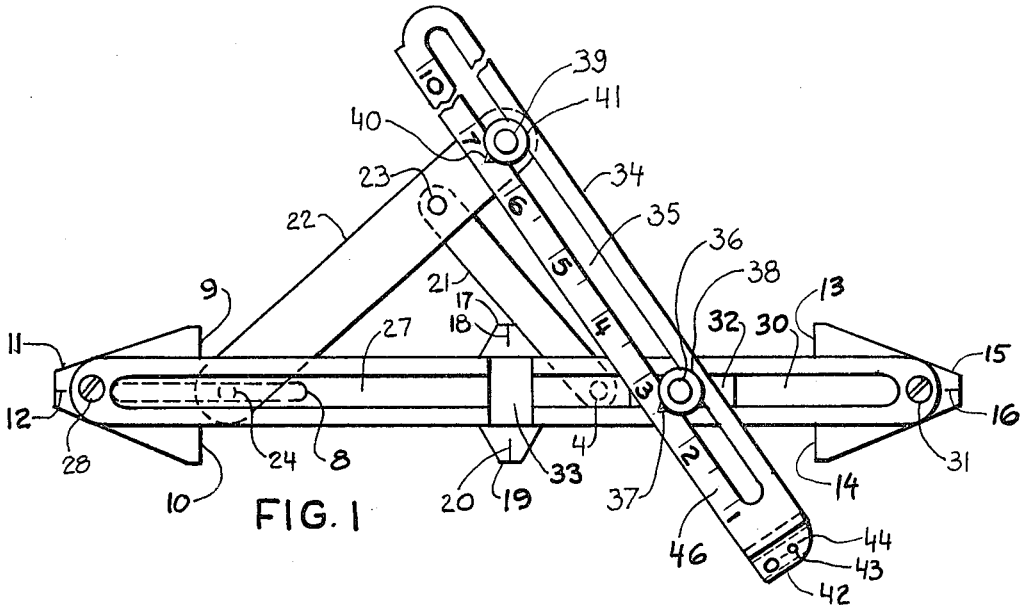
FIG. 1 depicts a top or plan view.
Figure 2:
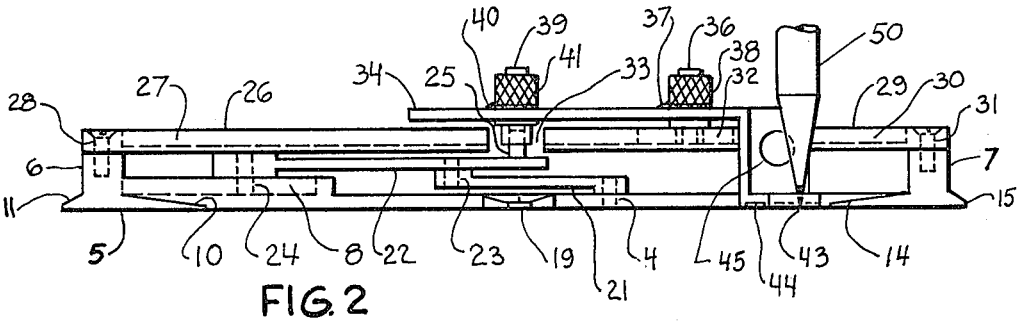
FIG. 2 illustrates a front view of the ellipsograph depicted in FIG. 1.

Referring to the drawings, numeral 5 indicates a lower base with its stepped up ends 6 & 7. Said lower base 5 has a groove 8 along and centered on the line connecting the center line indicator 12 & 16 adjacent to end 6. End 6 of base 5 has a fastening lug 9; and fastening lug 10 and lug 11 has center line indicator 12 on it. End 7 of the base 5 has a fastening lug 13; and fastening lug 14 and lug 15 has a center line indicator 16 on it. The center of the lower base 5 has a lug 17 with center line indicator 18 on its and lug 19 with center line indicator 20 on it. Affixed pivotally on a line connecting center line indicator 12 and 16 adjacent to end 7 of the lower base 5 is a rotary arm 21, capable of being pivoted about shaft 4; and the second end of the rotary arm 21 is rotatably connected to elongated plate 22 by shaft 23. One end of the elongated plate 22 is mounted in slot 8 by shaft 24 for reciprocal, linear and rotary motion. The other end of the elongated plate 22 carries fixed upwardly projected shaft 25. The length of groove 8, the distance between shaft 23 and shaft 24, the distance between shaft 23 and shaft 25 and the distance between shaft 23 and shaft 4 are of such length that the center of shaft 25 when set in motion will move on a straight line joining center line indicator 18 and 20 perpendicular to the line joining groove 8 and shaft 4. The upper base 26 having groove 27 cut lengthwise in its upper surface is bolted to the lower base's end 6, with bolt 28. The base 29 having groove 30 cut lengthwise in its upper surface is bolted to the lower base's end 7, with bolt 31. Both grooves 27 and 30 are in line with a line which joins center line indicator 12 and 16. Bridge bearing 32 is reciprocally slideable in grooves 27 and 30; and is of such length as to be able to cross space 33 while being retained therein. Space 33 centered over the line which joins center line indicator 18 and 20 is wide enough to clear hubs 36 and 39. A scribe arm 34 has at its one end a lengthwise slot 35. The slot 35 carries the lockable hub 36 and attached to it is scale indicator 37, designed to slide in the slot 35 when its fastening screw 38 is loosened. The slot 35 carries another lockable hub 39 and attached to it is scale indicator 40, designed to slide in the slot 35 when it's fastening screw 41 is loosened. The second end of the scribe arm 34 has a stepped down end 42 a scribe hole 43, clearance groove 44 and mounting hole 45 used for mounting drafting instruments. The upper surface of the scribe arm 34 has engraved or printed on it scale 46, starting from 0 at the centerline of the scribe arm hole 43 and ending at the othe end of slot 35. The scribe arm 34 is rotably mounted through the slot 35 by hub 39 on the upwardly projected shaft 25 and in the hole of the bridge bearing 32 through the slot 35 by hub 36.

Figure 3:
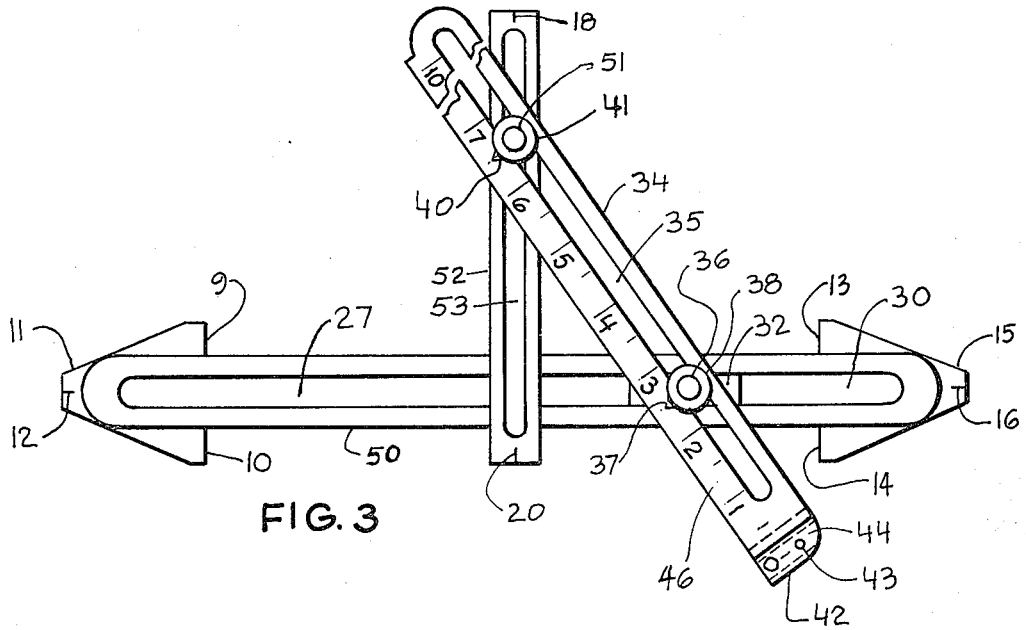
FIG. 3 depicts a top or plan view of a second embodiment of the ellipsograph.

The rotary arm 21 and the elongated plate 22, in conjunction, are guiding hub 39 on a straight line. In FIG. 3, the rotary arm 21 and elongated plate 22 are replaced by plate 52, having groove 53. The groove 53 is guiding hub 51, which is longer than hub 36, on a straight line perpendicular to the line joining the center line indicator 12 & 16. The plate 52 is slideably mounted on the modified base 50, and will move reciprocally from one side to another, by aid of hub 51, or by the aid of ones hand. The operation of the ellipsograph is as follows:

Place the ellipsograph what it's center line indicator 12 and 16 over the major axis of the desired ellipse and it's center line indicator 18 and 20 over the minor axis of the desired ellipse. Fasten lugs 9, 10, 13 & 14 to the drafting media with drafting tape, or when used on steel, with magnetic lugs. On the scale 46 of the scribe arm 34, set the hub 39 with its scale indicator 40 on the dimension of one-half of the major axis. Fix the hub 39, by tightening screw 41. Then on the scale 46 of the scribe arm 34, set the hub 36 with its scale indicator 37 on the dimension of one-half of the minor axis. Fix the hub 36, by tightening screw 38. Place the point of a pen or a pencil 50 in scribe hole 43 and draw an ellipse.

The said ellipsograph is designed to draw bigger ellipses than itself. But if a smaller ellipse is to be drawn, place the ellipsograph with its center line indicator 18 and 20 over the major axis of the desired ellipse, and reverse the mounting of scribe arm 34. The ellipse will be drawn in two parts having a gap on its minor axis equal to the width of the base. The gap can be filled in by an additional reseting of the ellipsograph.

While I have described the invention along specific lines, various minor changes or refinements may be made therein without departing its principle. And I reserve the right to employ all such changes and refinements as may come within the scope and spirit of the appended claims.

What I claim as new is:

1. A drafting instrument for tracing an entire ellipse, or parts thereof, comprising a lower base with a first and second end and center, each of said ends bearing mounting lugs and a center line indicator, with another center line indicator on each side of the base at its center, the upper surface of said lower base having a groove from a point adjacent to the first end to a point adjacent to the center, a rotary arm whose first end is pivotally connected to the upper surface adjacent to the second end of said lower base, an elongated plate whose first end is mounted by connecting means to said groove so as to permit linear motion of said end along said groove, with the second end of said plate carrying an upwardly projected shaft, said plate being pivotally connected to the second end of the rotary arm at a predetermined point so that as the first end of the plate travels along the groove the upwardly projected shaft moves on a straight line along the center line indicator at the center of said lower base, an upper base rigidly affixed at both ends to the ends of the lower base, said upper base having a groove between points adjacent to each end with the center of said groove lying on the same line joining the center line indicators on the ends of the lower base, a bridge bearing reciprocally slideably mounted within said groove, said upper base having a gap orthogonal to said groove and at its center portion, the gap of sufficient dimensions to allow unobstructed motion of the upperwardly projecting shaft, a scribe arm having a lengthwise slot between points adjacent to each end, said scribe arm having at its first end means for mounting a drafting instrument, a first rotably connecting means between the upwardly projecting shaft and said slot as a point near the second end of said scribe arm, and a second rotably connecting means between the bridge bearing and said slot at a point between the first connecting means and the second end of said scribe arm.

* * * * *